US006809654B2

(12) United States Patent
Hudson

(10) Patent No.: US 6,809,654 B2
(45) Date of Patent: Oct. 26, 2004

(54) MESSAGE BOARD WITH WORK LIGHTS FOR VEHICLES

(76) Inventor: Ed Hudson, 3 Farrows St., Putnam, CT (US) 06260

( * ) Notice: Subject to any disclaimer, the term of this patent is extended or adjusted under 35 U.S.C. 154(b) by 0 days.

(21) Appl. No.: 09/863,227

(22) Filed: May 24, 2001

(65) Prior Publication Data

US 2002/0175830 A1 Nov. 28, 2002

(51) Int. Cl.[7] ..... G08G 1/095

(52) U.S. Cl. ..... 340/907; 340/908.1; 340/932.1; 340/468; 340/471; 340/480; 340/487

(58) Field of Search ..... 340/907, 908, 340/908.1, 932.1, 425.5, 468, 471, 472, 473, 480, 487, 488, 489, 490; 40/591, 592

(56) References Cited

U.S. PATENT DOCUMENTS

| | | | | |
|---|---|---|---|---|
| 3,622,980 A | | 11/1971 | Elledge | |
| 3,761,890 A | * | 9/1973 | Fritts et al. | |
| 4,152,854 A | | 5/1979 | Berry et al. | |
| 4,259,660 A | | 3/1981 | Oliver | |
| 4,835,515 A | | 5/1989 | McDermott et al. | |
| 4,876,812 A | | 10/1989 | Haralson | |
| 4,992,788 A | * | 2/1991 | Arndt | 340/908 |
| 5,281,948 A | * | 1/1994 | Estrada | 340/433 |
| 5,406,250 A | * | 4/1995 | Reavell et al. | 340/433 |
| 5,450,058 A | | 9/1995 | Collier | |
| 5,542,203 A | | 8/1996 | Luoma et al. | |
| 5,636,462 A | | 6/1997 | Kleiman | |
| 5,917,431 A | | 6/1999 | Sanada et al. | |
| 6,412,203 B1 | * | 7/2002 | Libhart et al. | 40/591 |

* cited by examiner

*Primary Examiner*—Julie Lieu
(74) *Attorney, Agent, or Firm*—Philip Koenig

(57) ABSTRACT

A deployable message display and work light structure for attachment to a vehicle. Said structure comprises an anchor assembly attachable to the front or rear end of a vehicle, a message display panel support frame having parallel arms hingedly secured at their lower end to the anchor assembly, and a message display panel secured to the upper end of said arms. Said support frame may be rotated between a stored position, in which said arms follow the upper surface contour of the vehicle, and a substantially vertical raised display position whereby said message display panel is viewable to oncoming motorists. Work lights secured to the frame below said panel shine downward to illuminate the site without spilling glare in the eyes of motorists. Preferaby the display panel displays in alternative flashes a one word message and a graphical representation of open and closed travel lanes.

24 Claims, 6 Drawing Sheets

MESSAGE BOARD WITH WORK LIGHTS FOR VEHICLES

BACKGROUND OF THE INVENTION

1. Field of the Invention

The invention relates to vehicle-borne emergency traffic signaling devices, and particularly to emergency traffic signaling devices carried on police cruisers, tow trucks, road-side work trucks and other vehicles designed to provide emergency road service to motorists.

2. Background and Description of Related Art

Normal traffic flow is subject on a regular basis, daily on many thoroughfares, to impediments resulting from automobile breakdowns, accidents, and road repairs, which are a significant source of delay and irritation to the motoring public. While events of breakdown and accident are in a statistical sense largely inevitable, the length of delay caused by any one such event depends on a variety of factors; one important and often disregarded factor is the confusion and distraction which the precipitating event, and the police or other emergency response to that event, cause for other motorists approaching the vicinity of the event.

Typically the occurrence of an accident on a highway is followed by the arrival of a cluster of emergency vehicles, which block one or more of the traffic lanes and which display several arrays of extremely bright and multicolored flashing lights. The effect on oncoming traffic is generally sudden confusion, anxiety, and stress. At night and on days where vision is furthered hampered by fog, snow or smoke, an accident scene is even more confusing, especially to elderly drivers, and it creates a set of circumstances with a high risk of secondary accidents.

Upon the arrival of a tow truck to remove a disabled car from the roadway, the disabled vehicle has usually already been pushed off the roadway onto the shoulder, and to effect its removal the tow truck is driven to a position in front of the disabled vehicle. If the tow truck's flashing lights are not already on, they are now switched on to inform traffic oncoming in the travel lanes, from either direction, that a recovery operation or repairs are in progress. At night, rearward-facing bright work lights on the tow truck are usually also switched on, to illuminate the truck's winch mechanism and the area on and behind the tow truck bed. Often these bright working lights direct a blinding glare into the eyes of oncoming drivers, adding to an already confusing and dangerous situation. Commonly a police vehicle sporting bright flashing lights is also at the scene, typically stopped behind the disabled vehicle, which is now bracketed by the police vehicle and the tow truck.

All too often the emergency signaling equipment of the emergency vehicles, including the bright flashing lights of both police vehicles and emergency repair vehicles such as tow trucks, exacerbate rather than ameliorate the confusion and anxiety of oncoming motorists. Furthermore this emergency signaling equipment in fact provides virtually no useful information to drivers suddenly confronting the scene of an emergency: the flashing blue lights of police cars identify the fact of an emergency event, but they provide no other useful information to motorists and they may be so bright as to impair the view of oncoming motorists.

The same is true for the bright work lights of tow trucks: while at night they serve the useful purpose of illuminating the accident scene for emergency personnel, they too often spill blinding glare that seriously impairs the visibility of oncoming motorists, and they provide no information useful to motorists for minimizing the distraction, risk of secondary accidents and delays that result from the precipitating event. There is accordingly a need to equip emergency vehicles, including both police cruisers and tow trucks, with programmable signaling means adapted to inform oncoming vehicles effectively with usable information regarding the roadway impediment, of a nature that will minimize the traffic congestion and risks of accidents associated with highway emergencies.

In general it is highly desirable to provide emergency vehicles with effective means of signaling motorists, at the earliest possible time, of a roadway obstruction in their line of travel, in order to assist the motorists to progress past the obstruction with a minimum of delay, a minimum of risk, and a minimum of irritation.

In the prior art numerous efforts have been made to address these concerns, with varying degrees of effectiveness. In the case of planned traffic obstructions, such as are caused by planned repairs to the roadway, effective means presently exist for informing oncoming motorists of the obstruction, and of ways of circumventing it with minimum confusion and delay. For example, U.S. Pat. No. 3,883,846 issued to Bruner, and U.S. Pat. No. 3,622,980 issued to Elledge each discloses a towable trailer, bearing an illuminated signpost, that may be towed to positions suitable for advising oncoming traffic of the roadway obstruction, and such trailers, typically powered by batteries but sometimes by solar panels, have become ubiquitous at roadway repair sites.

Trailer-borne signal display devices are not suitable, however, for assisting highway travelers to negotiate suddenly occurring roadway obstructions and emergencies, caused by accidents, vehicle breakdowns, and the like.

A variety of signal display devices have been disclosed that are mountable on vehicles, including devices intended for mounting on passenger vehicles and devices intended for mounting on the cab or the cargo bed of trucks. Many such devices are intended for use by ordinary motorists, as emergency equipment to be carried in their cars, in the manner of and in addition or replacement of devices such as emergency flares. For example, U.S. Pat. No. 5,103,205 issued to Halligan discloses a traffic warning apparatus for mounting on the trunk of a passenger automobile, which device features an illuminated arrow (storable within the trunk of the automobile) which can be set up to point left or right, and to use the auto's existing warning light flasher circuit to flash an arrow signal directing following traffic to move into a selected traffic lane adjoining that of the signaling automobile.

Some prior art signal display devices are intended for permanent attachment to the roof of a passenger vehicle or a truck cab. Thus, U.S. Pat. No. 4,152,854 issued to Berry discloses a roof-mounted warning signal apparatus, including folding means for configuring the signal display means in either an upright, signaling position or a horizontal storage position that minimizes air drag when the vehicle is in motion. Another roof-mounted signaling apparatus, disclosed in U.S. Pat. No. 4,835,515 issued to McDermott, features a frame having light-bearing arms that can be formed into an arrow, pointing left or right as desired. While helpful to following motorist in providing lane-changing information, these devices fall far short of providing motorists with the information needed to minimize delay, confusion and irritation attendant upon roadway emergencies.

OBJECTS OF THE INVENTION

It is a principal object of the invention to provide highway emergency repair vehicles, such as police cruisers and tow trucks, with message display and work-site lighting means, deployable from a stored position to a raised operating position, that enables roadway emergency worksites to be illuminated without directing hazardous glare into the vision field of oncoming motorists, and that also provides means to display informational and instructional messages to motorists, oncoming from either travel direction, that can assist motorists to navigate the work site area with a minimum of confusion, uncertainty and risk of accident.

It is therefore an objective of the present invention to provide means to illuminate a temporary roadway or roadside work area, such as an accident site or a disabled vehicle, that does not also direct or spill hazardous glare in the vision of oncoming motorists. It is another and related object of the invention to provide a means to display, in a manner visible to oncoming motorists from a substantial distance, information concerning the accident or other roadside obstructing event that will assist motorists in navigating the obstructed site with minimal confusion, anxiety and risk of involvement in a secondary accident.

It is another object of the invention to provide means to equip an highway emergency vehicles, including police cruisers and road repair and removal vehicle, such as tow trucks, with deployable message display means comprising a rectangular message panel having on a front and/or a rear surface electronically controlled illuminated arrows and alpha-numeric characters for displaying pre-programmed directional arrows and/or informational or instructional messages.

It is yet another object of the invention to provide deployable message display means for attachment to a highway emergency vehicle, whereby the message display means may be disposed, for transport or storage, in an aerodynamically stable storage position in which the message display means are physically aligned with the contours of the vehicle, and that may also be disposed in a display position, in which a message display panel is disposed vertically above the roof of the vehicle, in a manner that exposes at least one message display surface to oncoming motorists.

It is a further object of the invention to provide a deployable message display panel for a highway emergency vehicle, which, when disposed in a vertical operating position, may be rotated about a vertical axis whereby messages displayed on one or on both sides of the display panel may be viewable from directions angled to the vehicle It is yet another object of the invention to provide a deployable message display panel for a highway emergency repair or removal vehicle, wherein the display panel is supported by a structure also comprising work lights and wherein erection of the display panel from a horizontal storage position to a vertical operating position also causes said work lights to be correctly position to illuminate a work area, or accident site, at the rear and/or at the sides of the emergency vehicle or repair vehicle without directing glare in the vision of motorists on the roadway.

It is a related object of the invention to provide means to dispose work lights on a highway emergency repair vehicle to a sufficient height above the work area required for the operation of the emergency vehicle that strong bright lights, such as halogen luminaires, may be directed downward to illuminate brightly the work area of the emergency or repair vehicle without spilling substantial glaring light into the vision field of motorists approaching said work area.

It is also an object of the invention to provide the work light means described above in conjunction with illuminated message display means, in such a manner that, in operating position, the work lights do not spill glare onto or otherwise obscure the message display means. It is a related object of the invention to provide such message display means that are illuminated by electronically powered liquid display crystal components, or electrical illuminating elements, which are shielded from glare both from the work lights and from reflections from the roadway work site illuminated by the work lights.

It is accordingly an object of the present invention to provide vehicles or other mobile equipment with means to display to highway travelers, usually on a temporary basis, brief and easily grasped information concerning an abnormality such as an obstruction, using in combination a short or abbreviated textual message (such as "TOW", "CAUTION", "CONS" (for "construction") "ACC" (for "accident") and the like), and a graphical lane condition message, using directional arrows and Xs to represent open and closed travel lanes respectively.

It is a related object to provide means for such messages and instructions to flash for greater attention-getting.

It is also an object of the invention to provide emergency road service vehicles with means to illuminate the work-site and also to display messages to motorists that is inexpensive to construct and simple to operate.

It is also an object of the invention to provide emergency road service vehicles with means to illuminate the work-site and also to display messages to motorists that is readily attachable to, or removable from, an emergency road service vehicle.

SUMMARY OF THE INVENTION

The present invention is a vehicle-borne deployable work-light and message display panel, for use on many types of roadway emergency and repair vehicles, and also on vehicles used for roadwork repair, snow removal and other roadway activities. Generically the deployable message display panel of the invention is movable between a stored position and a deployed viewing position, in which the message display panel and work lights are deployed to a vertical position at a sufficient height above the panel-carrying vehicle, and the roadway, whereby the display panel can be seen (and read) from a distance and over intervening automobiles by oncoming motorists, and the work lights can illuminate an emergency site without spilling glare in the eyes of oncoming motorists. In its stored position, the message display panel does not mechanically or aerodynamically encumber the normal operation of the vehicle, and it may in addition contribute to the crashworthiness of the vehicle.

The vehicle-borne deployable message display panel of the invention comprises a message display panel comprising a matrix of electrically-powered light-emitting or light-reflecting elements, a panel-supporting frame hingedly secured to the vehicle, movable work lights secured to the supporting frame, and, optionally, an electro-mechanical or hydraulic mechanism for rotating the frame between a stored or travel position and a raised viewing position. In addition, pre-programmed electrical circuitry is provided that enables a user to select for illumination on the display panel, preferably in alternating flashes of a few seconds' duration, a word or abbreviation denoting the nature of the emergency or activity ("TOW" or, say, "ICE"), and a graphical matrix representing the open and closed travel lanes.

The message display panel and work-light structure of the invention is supported by a lightweight frame that, in the preferred embodiments of the invention, comprises members having dimensions and a precise shape custom-tailored to the specific type and model of roadway assistance vehicle to which it is intended to be affixed. However the invention is applicable to every common type of motorist assistance, emergency response, or roadway repair vehicle, including police cruisers, tow trucks, ambulances, highway repair vehicles (dump trucks, etc.) and specially equipped quick deploy vehicles such as fire control vehicles.

Once attached to a vehicle, the message display panel and work-light structure of the invention may be secured in a down storage or transport position, in which the message display panel generally rests in a horizontal position on the cab of the vehicle (or another comparable, horizontal surface where such storage does not impede travel or other normal use and operation of the vehicle), but the message display panel may be quickly deployed to a raised viewing position, for use when the panel-bearing vehicle has responded to an roadway situation that warrants providing other motorists with road hazard information.

In its simplest embodiments the message display panel and work-light structure of the invention is be supported by a lightweight frame that is raised manually between a storage position and an operating position. In the alternative, electro-mechanical or hydraulic means may be provided to rotate the frame supporting the message display panel from the stored position to the raised viewing position. Optionally, means may also be provided enabling the length of intermediate frame members to be adjusted when the frame is in the raised position, thereby varying the height of the message display panel above the highway, as needed for best visibility to motorists.

The vehicle-borne deployable message display panel structure of the invention is also adapted to carry high-intensity work lights for use in roadway emergencies that occur during low light conditions (night-time, etc.), in order to illuminate the emergency site for emergency personnel. Such high-intensity work lights are preferably positioned on the display panel-supporting frame immediately below the message display panel, and directed to shine down on the critical area in a manner that avoids the spillage of glare into the eyes of oncoming and passing motorists. Further, these downward illuminating lights may optionally be rotatably mounted on the tip of rods extensible and/or pivotable outward from the display panel supporting frame, whereby said lights can be extended laterally outward to illuminate a wider work area. The principal criteria for the positioning of said lights on the panel-supporting frame is that they not spill glare into the eyes of motorists and do not obscure the message displayed on the display panel.

Preferably the lamps used for such illumination are housed in luminaires comprising means for varying the radius of illumination, as appropriate to the needs and circumstances of the roadside emergency, and said luminaires are mounted to said extensible arms via universal joints that permit each luminaire, and the light issuing therefrom, to be angled in any direction as desired, manually or by means of electrically powered servo mechanisms.

The message display panel of the invention preferably comprises, as the message display means, a sequentiable array of illuminating elements that is adapted to display a limited set of simple standard instructions. Thus, the word "TOW" may be displayed to inform motorists that a disabled vehicle is being towed away, and flashed alternately every few seconds with a graphic display comprising a matrix of arrows "↑" to indicate free travel lanes and Xs to indicate travel lanes blocked by the "TOW" operation. Such display of arrows "↑" and Xs mimics and represents the roadway lane (travel and blocked) conditions existing at the emergency site. Similar simple sequential instructions are provided to inform motorists of other emergencies.

Optionally the message display panel of the present invention can be provided with greater informational flexibility by using a matrix of illuminating or reflective elements the illumination of which is controlled by a programmable computer switching control, enabling the display of a wide variety of informational and/or instructional messages.

The vehicle-borne deployable message display panel of the invention is adapted to provide a simple, inexpensive, highly visible and quickly erected display of roadway information for emergency conditions.

DESCRIPTION OF PREFERRED EMBODIMENTS OF THE INVENTION

Figure 1:
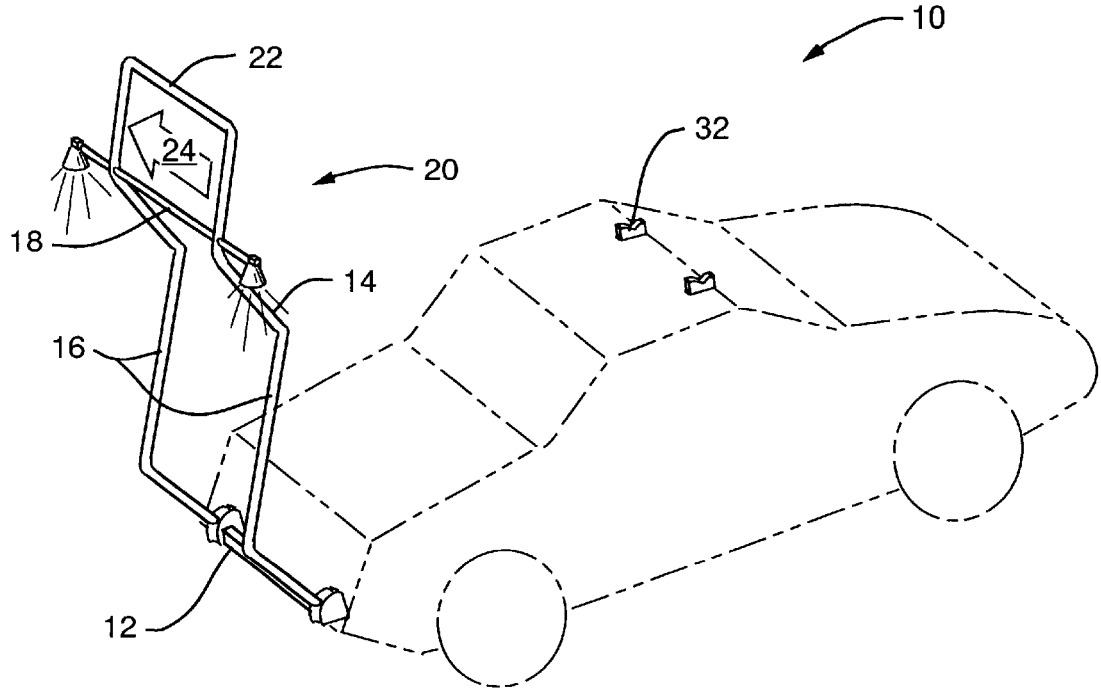
FIG. 1 is a perspective view of a police cruiser equipped with an embodiment of a deployable message display panel and work-light structure according to the invention, shown in the raised viewing position.

The present invention is believed to be most advantageously implemented through different embodiments that are respectively tailored and adapted to match the several types of emergency vehicles able to benefit from the fundamental attributes of the invention. A principal example is that of a police cruiser, and other examples include flat-bed tow trucks, tow trucks of the crane type, and snow removal equipment. In addition, however, the invention may be implemented in an adjustable embodiment designed to fit different vehicles having quite different contours and dimensions.

It is also believed advantageous that, like the mechanical structure of the message display panel and its support components, even the text and graphics to be displayed on the message display panel should be tailored to the particular type of vehicle bearing the panel. In a tow truck embodiment of the invention, for example, the most commonly displayed text message would preferably spell "TOW", while that displayed by snow removal vehicles might include the abbreviation "SNO", and that carried by police cruisers could be "POL". In the event the present invention came into wide use, either within one state or several, presumably conventions would become established regarding the specific word best suited, in a selected jurisdiction, to represent a particular type of emergency vehicle.

Preferably, however, the message boards of all vehicle types would have the pre-programmed capability to display any of several displays, singly or in combination, including the capability to displays a matrix of arrows and Xs, such as |↑|↑|↑|X, to represent open and closed driving lanes at the emergency site. Thus a tow truck operator, undertaking a "TOW" operation on a dual three lane highway in the right breakdown lane, could select for display the above matrix of arrows and (preferably, rapidly blinking) Xs, such as |↑|↑|↑|X, flashing alternatively every few seconds with a display of the word "TOW", to inform motorists that the breakdown lane was blocked by a tow operation and that other lanes were open for travel. Preferably the available pre-programmed displays would also include, for selection by the operator when appropriate to the emergency site conditions, the familiar blinking left or right arrows that urge drivers to merge leftward or rightward.

Police Cruiser Embodiment

The display message panel and work-light structure of the invention is particularly suitable for attachment to a police cruiser. It is commonplace for highway police officers, when pulling a car over on account of a traffic violation, or when coming upon a disabled car on the side of the roadway, to bring their police cruiser to a stop in back of the stopped vehicle, and, at night-time, to direct bright head lights, cab-top lights and possibly also a spot light at the stopped vehicle in front of the police cruiser. This practice is often unnecessarily humiliating to the stopped motorist, and the police cruiser's lights often direct a bright glaring light directly into the eyes of oncoming motorists in the travel lanes.

Adoption of the present invention by police departments would accordingly ease the task of the police officer making a traffic stop, reduce the risk of needless humiliation of the stopped driver, and substantially reduce the risky disturbance, distraction and confusion of other motorists on the highway. A preferred adaptation of the present invention to a police cruiser is shown in FIG. 1.

FIG. 1 shows a police cruiser 10 to which a message display assembly 20 has been secured and is shown in the raised or "display" position. Assembly 20 comprises an anchor element 12 which spans the front end of cruiser 10 and is secured by clamps, bolts or other suitable means (not shown) to the front bumper or, preferably, to front-end frame members of police cruiser 10. Alternatively anchor element 12 could be adapted for attachment to the rear end of a vehicle, as readily as to its front end. Anchor element 12 serves principally, as described below, to anchor and support the other components of message display assembly 20, but when located at the front end of the cruiser it is also positioned and may be shaped to serve as an auxiliary bumper providing additional crash protection and a vehicle-pushing means.

A display panel support frame 14 includes two parallel arms 16 and 16' that are removably and rotatably secured at their lower end to elements of anchor 12. Support frame 14 also comprises mediate cross-member 18 and, spanning the upper ends of arms 16 and 16', top cross-member 22, said cross-members being parallel to one another and substantially at right angles to arms 16.

Figure 4:
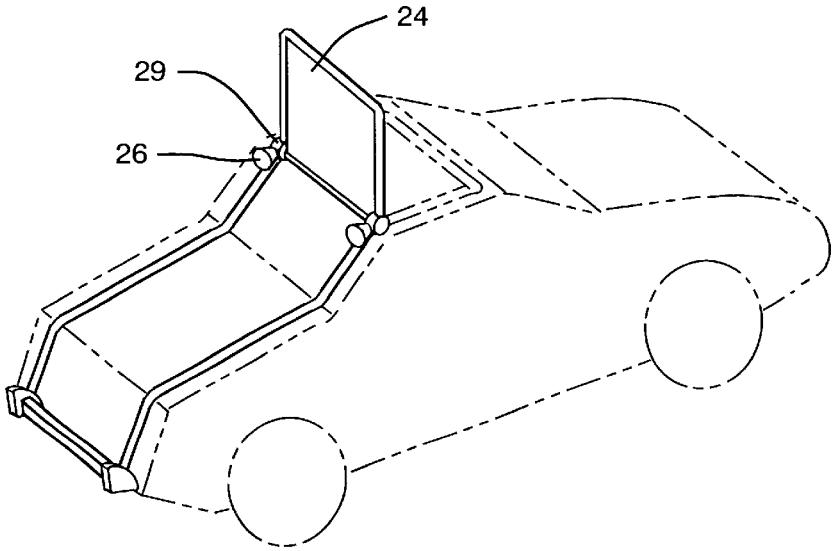
FIG. 4 is a perspective view of a police cruiser equipped with a third embodiment of the invention.

Rectangular message display panel 24 is seated and secured within the rectangle formed by arms 16 and 16' and cross-members 18 and 22. A work lights 26 is attached to each of arms 16 and 16' at the intersection of said arms and of mediate cross-member 18; to minimize its size said work light preferably utilizes high intensity halogen bulbs. Preferably (and as shown in FIG. 4) mediate cross-member 18 is tubular and each of work lights 26 and 26' is secured, by means of a universal joint 30, to the tip of retractable rods 28 that are positioned longitudinally within mediate cross-member 18 and that are extractable through an orifice in arms 16, thereby permitting work lights 26 and 26' each to be drawn laterally outward from vehicle 10 and also to be rotated to provide illumination in any selected direction. Most advantageously, said universal joint is electro-mechanically operated and makes use of servo mechanisms in the manner of conventional automobile side-view mirrors, whereby the operator of the police cruiser may control the direction of illumination of each work light using a control knob in the dashboard area of the cruiser, or using a wireless device such as a portable infrared communications device.

Figure 2:
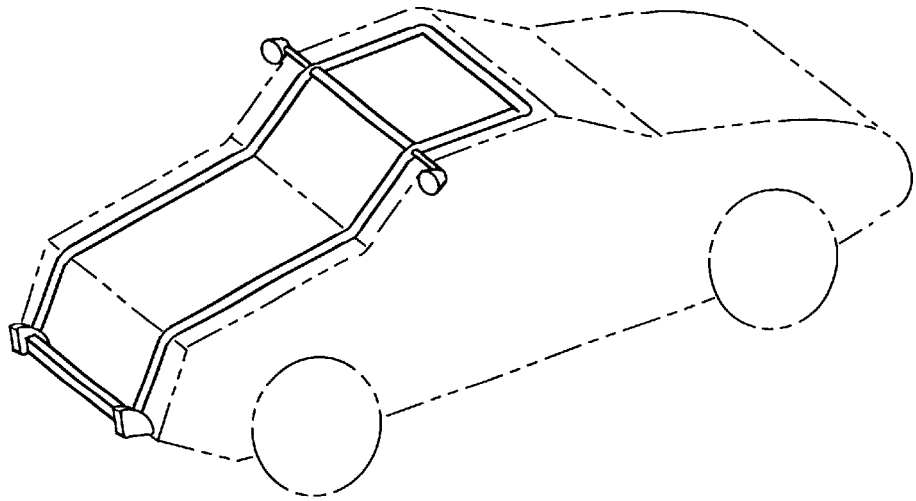
FIG. 2 is a perspective view of the embodiment of FIG. 1 with the deployable message display panel and work-light structure shown in the storage or transport position.

As shown in FIG. 2, which illustrates message display panel structure 20 shown in the storage or travel position, panel support arms 16 are shaped to follow the contour of the fenders, engine compartment, windshield and roof line of police cruiser 10 when said support arms are in a retracted position suitable for high speed operation of the cruiser. In this retracted position of arms 16, display panel 24 lies substantially flat on the roof of the cruiser, and the entire assembly is in an aerodynamically stable position permitting high-speed operation of the police cruiser. Arm clamping means 32 attached to the roof of cruiser 10 on each side of the roof to receive and secure arms 16 and 16' and prevent jiggling or vibration of said arms in the course of travel.

Upon bringing the police cruiser to a stop close behind a stopped automobile, message panel support frame 14 is raised and secured in the raised position. As said frame rotates upward to the panel display position, work lights 26 are directed downward and, if activated, illuminate the stopped automobile. In this manner, the front seat and leg area of the stopped automobile are illuminated far more effectively than is presently the case, where the cruiser's headlamps illuminate the trunk of the stopped car from knee level and cause reflected glare that impairs the police officer's ability actually to see into the passenger compartment.

Figure 3:
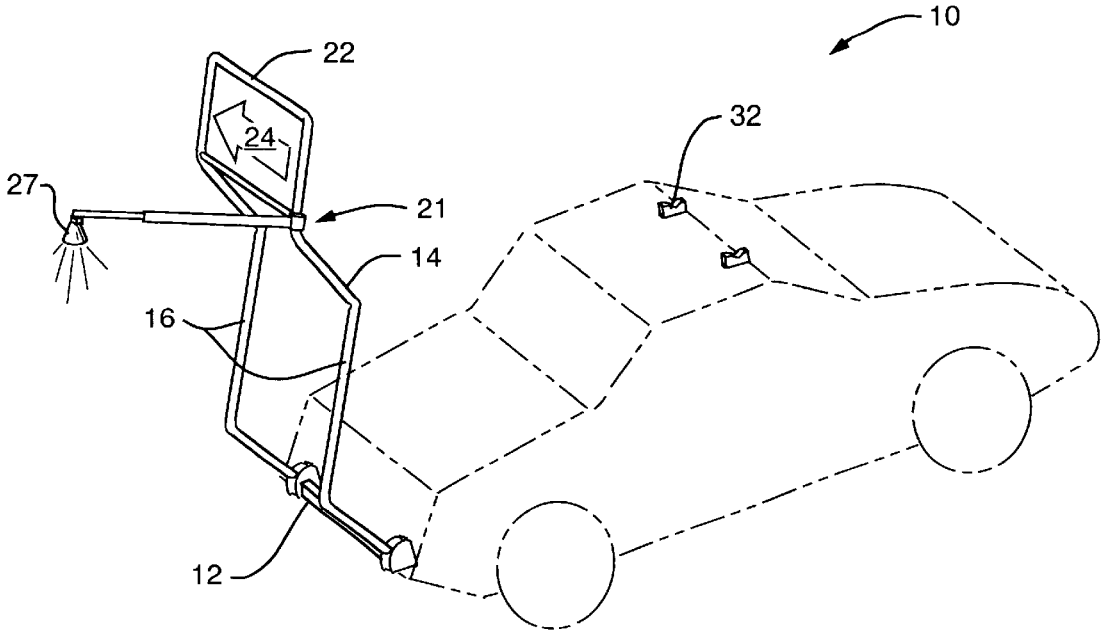
FIG. 3 is a perspective view of a police cruiser equipped with a second embodiment of the invention.

In another embodiment illustrated in FIG. 3, a work light 27 may optionally be positioned at one end of a rod 19 pivotably attached at its other end 21 to one of arms 16 or 16', parallel to and just below cross-member 18. Thereby, when arms 16 are in the fully raised position, rod 19 may be pivoted horizontally about a nearly 360° arc and work light 27 correspondingly positioned at any point over said arc, including the front, rear, or side of cruiser 10. Furthermore, rod 19 may be telescopic in order to extend the radius of the arc over which work light 27 may be positioned. Where such a structure is equipped with electro-mechanical servo mechanisms, a police officer is enabled to direct work light 27 to shine into and illuminate for example the interior of a stopped vehicle from a close range and without having to exit the police cruiser.

In yet another embodiment illustrated in FIG. 4, display panel 24 may be pivoted to a vertical viewing position when panel support frame 14 is in the down travel position. In this embodiment arms 16 and 16' each have an upper and a lower portion, joined by a two position hub 29 positioned at or just below the joinder of cross-member 18 to arms 16, whereby display panel 24 may be pivoted to either of two positions: one in which said panel is viewable by motorists when display panel support frame 14 is fully raised, and the other, illustrated in FIG. 4, in which said panel is viewable to motorists when said support frame is in the lowered travel position. In this embodiment work lights 26 may be secured either to arms 16 just below hubs 29 or to hubs 29.

It is contemplated that the principal structural elements of the message display support frame 14 will be manufactured principally using strong and light materials, such as carbon fiber and/or aluminum tubing, resulting in a structure that is sufficiently light to be movable manually between its storage position and the raised or operating position. Optionally, a hand-powered ratchet mechanism or a simple electro-mechanical assist (neither of which is shown) can be provided to raise the message display panel and work lights to the raised display position.

It is contemplated that work lights 26, any motor employed to rotate said work lights, and the light-emitting elements of the message display panel, will all be powered by the battery and electrical system of the vehicle bearing the message display panel structure, and that wiring snaked through one or both of tubular support arms 16 will serve to connect the vehicle electrical system, and any work light and panel display controls in the cab of the vehicle, to said work light and display panel components.

Figure 5A:
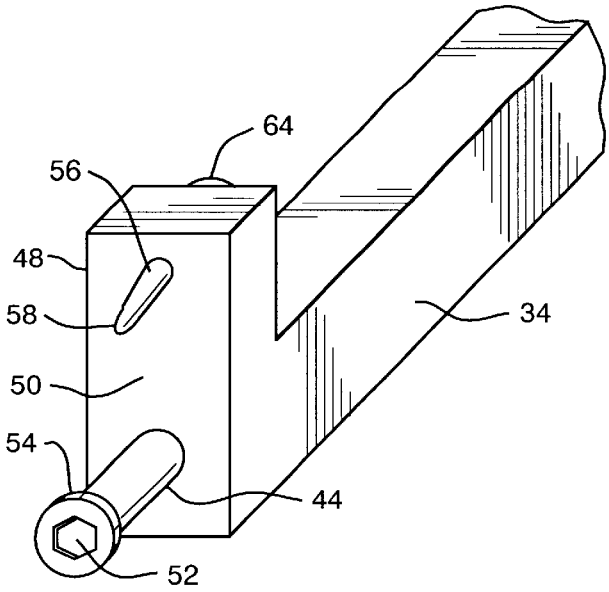
FIGS. 5(A and B) are perspective detailed views of elements for rotatably joining the message display panel supporting frame to an anchor assembly.

In the police cruiser embodiments of the invention shown in FIGS. 1–4, support frame 14 is raised into display position manually, and it is secured in its raised position by the support arm attachment mechanism illustrated in FIG. 5.

As shown in FIG. 5, anchor assembly 12 comprises horizontally disposed anchor beam 34, manufactured for example from 2" square (hollow) steel stock. Anchor beam 34 spans the front end of police cruiser 10 and it is clamped or bolted to the cruiser's front bumper, or to its frame, by attachment means (not shown) that are appropriate to the particular make and model of the police cruiser.

Arms 16 may be secured to anchor assembly 12 by any suitable means that permit said arms to be pivoted in parallel approximately 90 degrees about a fulcrum at their lower end, and thereby to be secured at either a "stored" position (whereby said arms follow the contours of the vehicle and the display surface of the message display panel rest substantially flat on the roof of the vehicle, and a raised "viewing" position (whereby said display surface lies in a vertical plane above the vehicle).

A simple example of such a suitable means of pivotably securing arms 16 to the body of a vehicle is illustrated in FIGS. 5(A and B). Said means comprise a pivot block 38 having a channel 40 for receiving the lower end of arm 16, and a bore forming an annular bearing 42 for engaging an axle. To provide for pivotable attachment of said pivot block and arm to the vehicle, an axle 44 aligned within anchor beam 46 exudes from end plate 50 in post 48 at each end of beam 34 (which is affixed to the bumper or frame of the vehicle), and said axle is adapted to receive and engage annular bearing 42 in pivot block 38. A bolt 52 with flanged head 54 secures pivot block 38 to axle 44. (Alternatively axle 44 could itself be simply a bolt with a flanged head, an unthreaded body and a threaded tip for engaging a threaded aperture in end plate 50).

Figure 5B:
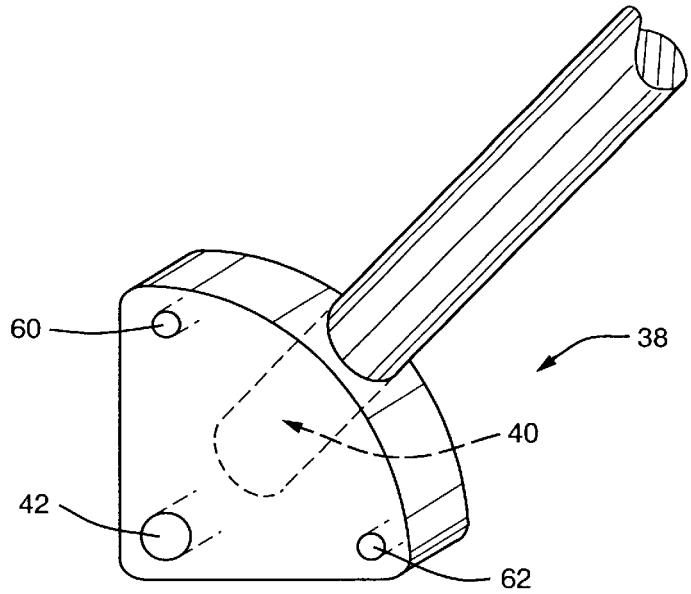
Figure 6:
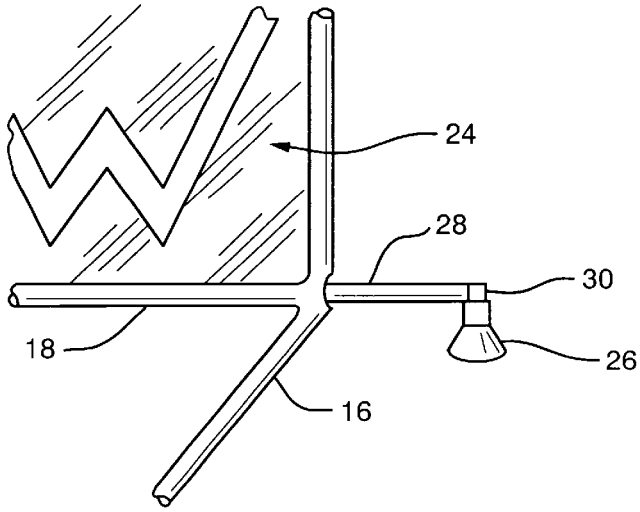
FIG. 6 is a perspective detailed view of work light attachment means employable with the embodiment shown in FIGS. 1–2.

As shown in FIG. 5B, pivot block 38 has parallel surfaces shaped generally like a right-angled isosceles triangle. Channel 40 for receiving the cylindrical lower end of an arm 16 is milled part way into the body of said block, bisecting said right angle. Annular bearing surface 42 is milled through said block near the right angle corner at right angle to said channel. Near each of the two acute angles in the surfaces of pivot block 38 there is an aperture through the body of said pivot block adapted to receive and engage tip 58 of a spring loaded pin 56 located in the upper part of post 48 attached to the end of beam 34. A first or "stored position" aperture 60 is positioned to lock arms 16 in the "stored" position, and the second or "raised position" aperture 62 is positioned to lock arms 16 in the raised viewing position. Spring loaded pin 56 comprises a spring (within post 48 and not visible in FIG. 5A) that urges the tip 58 of said pin towards pivot block 38, to securely but removably engage said pin within either of apertures 60 and 62. A knob 64 at the head of pin 56 allows the user to pull said pin from either aperture for unlocking pivot block 38 and pivoting arms 16 between positions. With this assembly arms 16 may readily be pivoted by hand between the stored position and the raised position and be secured at either position.

As earlier noted, electro-mechanical assist means may be provided for raising message panel support frame 14 to the raised position. For example, axle 44 may be a powered axle positioned longitudinally within anchor beam 34 for rotating support arms 16 upward and downward as desired. Said powered axle would preferably be powered by the battery and electrical system of the police cruiser, and controlled by control means in the cab of the cruiser and/or in a hand-held wireless device.

Besides serving to anchor and lock support arms 16, anchor structure 12 may readily be modified to function also as an auxiliary bumper means, able to broadly contact another vehicle to be pushed from travel lanes by the police vehicle. Preferably, anchor structure is manufactured of steel stock and support arms 16 are manufactured of a strong but light material, such as carbon fiber tubing or the like, and together these components form an energy-absorbing crash-protection assembly that serves to protect the operators of the cruiser in the event of a head-on collision between the cruiser and another vehicle or object. Optionally support arms 16 could be manufactured from, or contain sections manufactured from, an energy absorbing material that would provide still more crash protection to the occupants of the cruiser.

Flat-bed Tow Truck Embodiment of the Invention

The present invention is also suited for use on a tow truck, or other vehicle used to remove a broken down vehicle off the highway to be repaired, etc.

Figure 7:
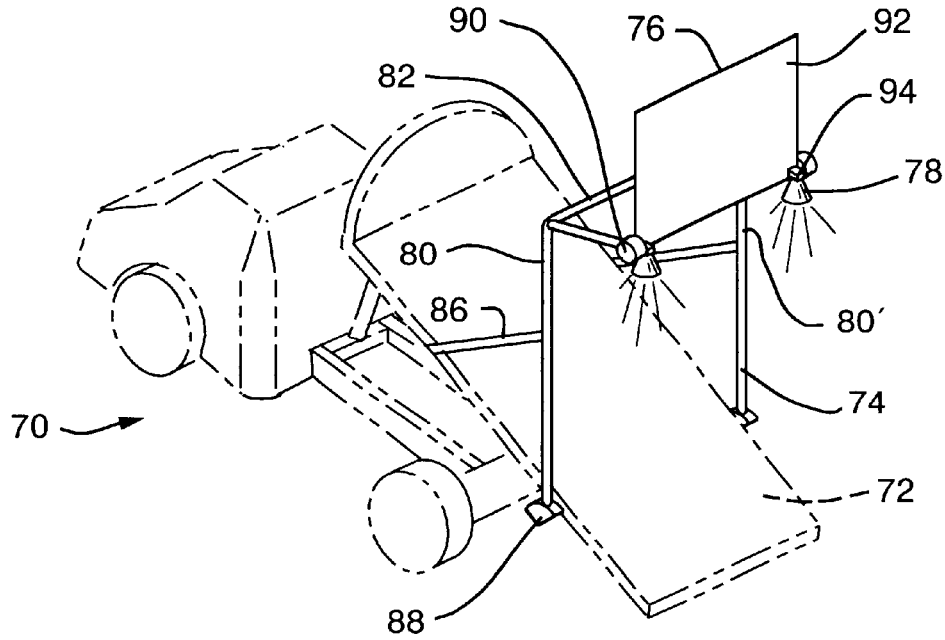
FIG. 7 is perspective view of an embodiment of the invention adapted for attachment to a flat-bed tow truck and shown in the raised display position.

Referring to FIG. 7 there is shown a tow truck 70 provided with a tilting bed 72 (here shown raised) upon which a disabled vehicle may be winched from the roadbed (either a travel lane or the roadside shoulder) for removal from the roadway. Tow truck 70 as shown is equipped with a deployable message display panel and work light structure 74 according to the invention.

Structure 74 comprises principally a message display panel 76, work lights 78 disposed beneath said panel, L-shaped arms 80 and a cross-member 82 forming a frame 84 for supporting said panel and said work lights, and powered frame deployment means 86 acting on said arms for rotating said panel and work lights between a stored position alongside the body of truck 70 and an elevated operating position. In said operating position message display panel 76 has been raised to a position above said truck at which oncoming motorists may readily view any message displayed on said panel.

Referring to FIG. 7, display panel supporting frame 84 comprises a pair of L-shaped arms 80 and 80' disposed in parallel, and a cross-member 82 which joins arms 80 at their elbow. The lower ends of arms 80 and 80' are pivotably secured to the side edges of tiltable truck bed 72 respectively by hinge members 88 and 88', and the upper ends of said arms are respectively affixed, by hubs 90 and 90', to opposite lower corners of display panel 76, and also to work lights 78 and 78'. Hubs 90 and 90' are preferably multi-spoke, multi-position lockable hubs, of the type described for example in U.S. Pat. No. 4,830,250 issued May 16, 1989 to N. Dixon and N. Levine. Use of such multi-position hubs allows display panel 76 to be pivoted to a vertical viewing position when frame 84 is in the lowered "travel" position.

Figure 8:
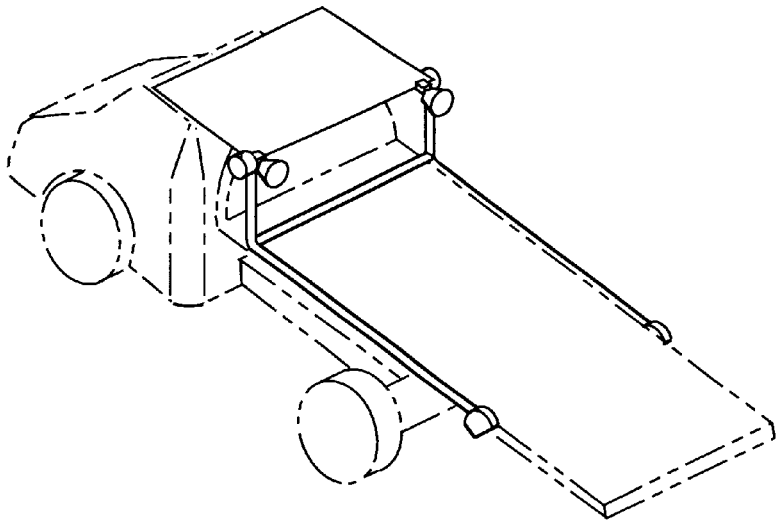
FIG. 8 is perspective view of the embodiment of FIG. 7 shown in the storage or transport position.

Preferably, and as shown on FIG. 7, powered frame deploying means 86 comprises conventional hydraulically-powered piston means, preferably as a pair disposed on each side of truck 70, each said means having one end hingedly attached to truck bed 72, at a point mediate the front of said truck bed and arm securing hinge 88, and the opposing end hingedly attached to arm 80 at a distance from hinge 88 selected to provide operative rotation of panel supporting frame 74 between a stored position alongside the body of truck 70 (shown in FIG. 8) and a fully raised viewing position (shown in FIG. 7) where message panel 74 is above any part of truck 70 and viewable by oncoming motorists. Preferably message panel 74 is sized to be as wide as truck 70, and thus may be 7 to 9 feet wide.

Figure 11A:
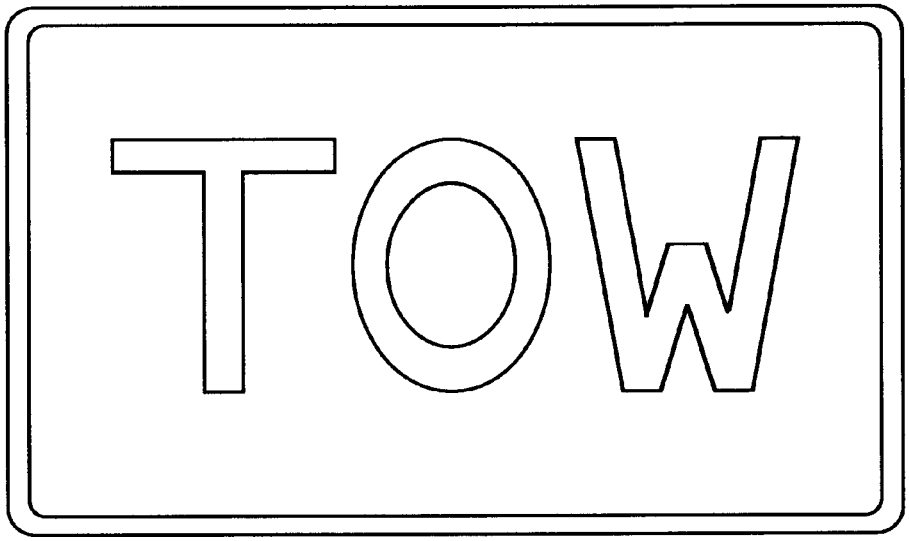
FIGS. 11(A–B) illustrates message panel displays for use with the invention.
Figure 11B:
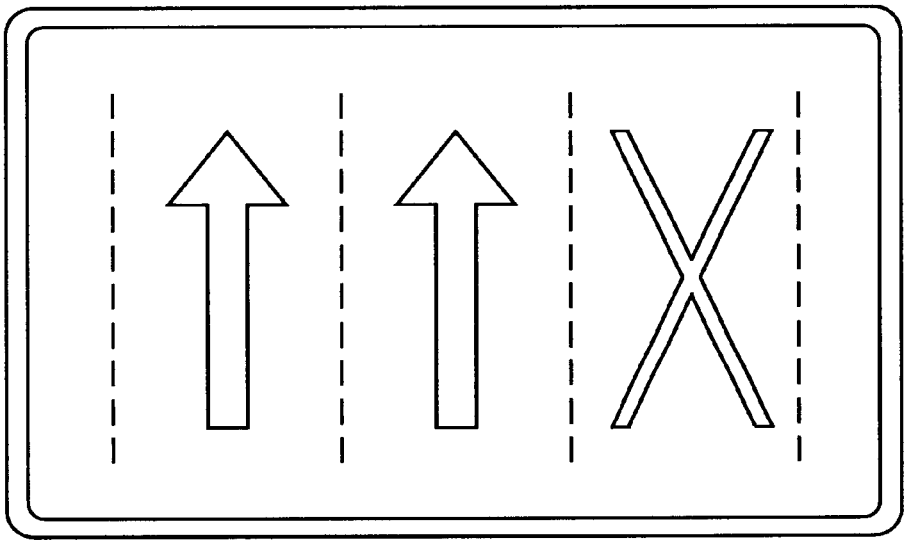

Message display panel 80 has a message display surface 92 (and optionally and preferably a second display surface on its obverse side) honey-combed with a plurality of light-emitting and/or light reflecting elements programmable for displaying selected alpha-numeric characters, geometric shapes and common graphic symbols such as arrows. Samples of messages to be displayed in the use of the invention are illustrated in FIGS. 11(A–B). Conventional electric and electronic means (not illustrated) are employed to power, program and control illuminated displays on surface 92 of panel 80; examples of means suitable for displaying programmed messages on such a panel are described for example in U.S. Pat. No. 5,636,462 issued to Kleiman and references cited therein.

Work lights 78 are disposed at or near hubs 90, for downward illumination of a work area to the rear or sides of truck 70 when message display panel 76 is in its raised operating position. Where hubs 90 are multi-spoke multi-position hubs, work lights 78 are secured to a short spoke 94 issuing from hub 90, at a preset angle whereby said work lights are directed to shine downward at a desired angle when deployed to the raised operative position.

When tow truck 70 has been stopped in front of a disabled vehicle, hydraulically powered deployment means 86 are empowered to rotate message panel 76 upward from a substantially horizontal to a substantially vertical operating position, as shown in FIG. 7, thereby positioning front and rear display surfaces 92 of message panel 76 vertically and above truck 70, and making said display surfaces readily viewable by traffic oncoming from either travel direction on the roadway.

When message panel 76 is rotated upward to an operating position, work lights 78 are caused automatically to rotate into a position that faces over and illuminates the work area (the tow truck bed and disabled vehicle), and said lights do not shine into the eyes of oncoming vehicle drivers. Emergency flashing lights can still be used but a greater dependency could be placed on a standardized set of signals and instructions which could be electronically placed on the message board to be viewed by drivers of oncoming vehicles.

This tow truck embodiment of the message display board of the invention is readily adaptable to use on dump trucks including dump trucks used in snow removal and salt/sanding operations in snowy weather. Such dump trucks, which often operate in conditions of poor visibility and which are required to operate in all travel lanes, are often a serious hazard to motorists, including slower motorists ahead of the dump trucks and faster moving motorists following and coming upon these trucks. For such applications, the message display panel 92 would normally be pivoted to a vertical viewing position, to display an appropriate warning message, when the truck is underway and the panel supporting frame 74 is in the lowered "travel" position.

Generic, Adjustable Embodiment of the Invention

Figure 9:
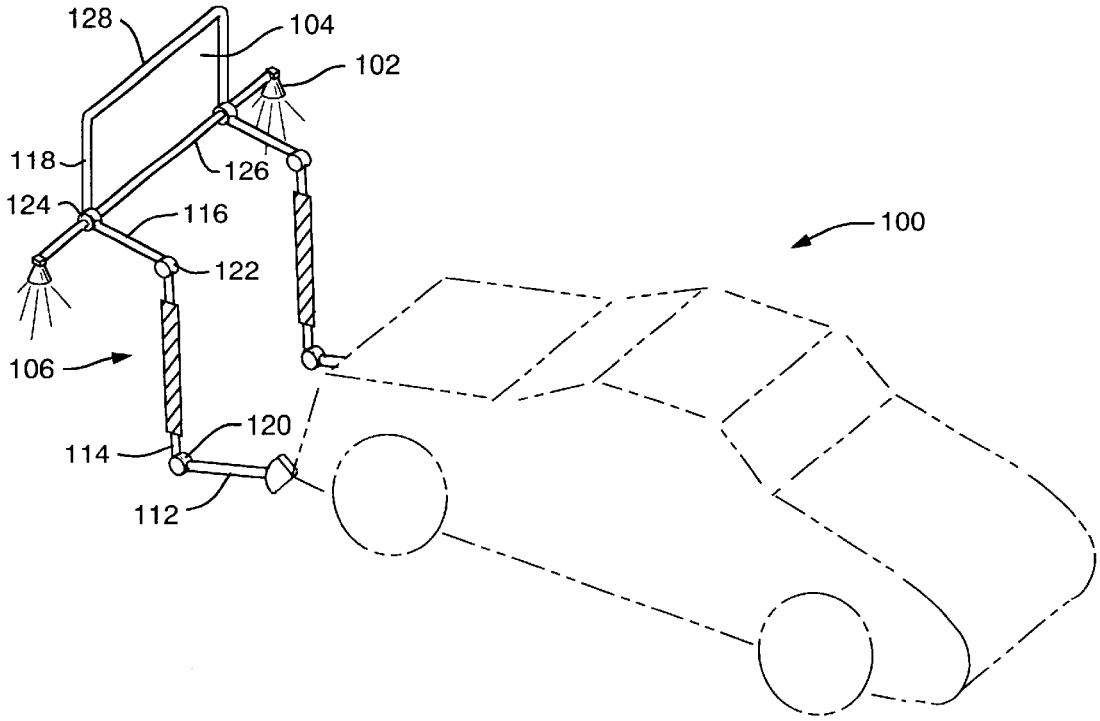
FIG. 9 is a perspective view of an adjustable embodiment of the invention shown in the raised display position.
Figure 10:
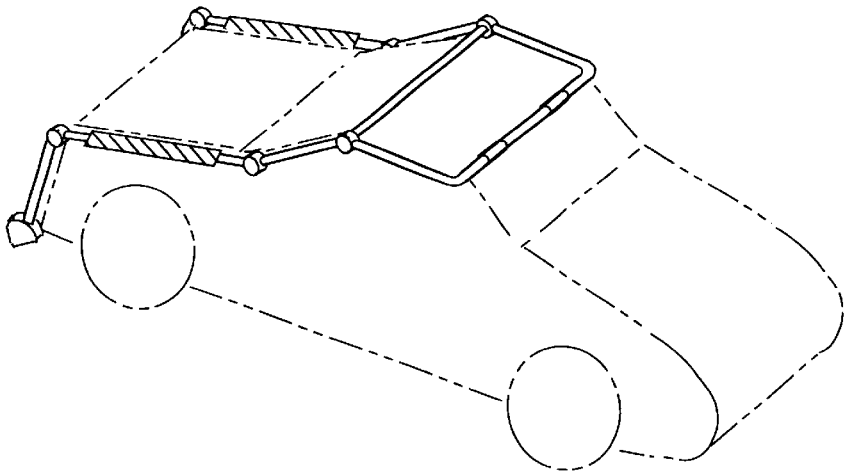
FIG. 10 is another perspective view of said adjustable embodiment of the invention shown in the stored or travel display position.

FIGS. 9 and 10 illustrate a generic, adjustable embodiment of the present invention, intended for application to varying models of sedan-type vehicles that differ somewhat in their dimensions. While it is recommended that the present invention be adapted to each type of emergency vehicle in a custom-tailored fashion, there may be circumstances where it is desirable to employ, for use on different models of a given type of vehicles, an adjustable embodiment of the invention, as shown for example in FIGS. 9 and 10. Said adjustable embodiment of the invention is generally similar to the police cruiser embodiments illustrated in FIGS. 1–4, with the following principal difference: in said embodiments, a display panel is supported by a supporting frame shaped as an integral unit to mimic the surface contour of a vehicle when said arms are in the storage or travel position; in the present adjustable embodiment, there is provided a display supporting frame that also comprises parallel arms and parallel cross-members, but wherein each arm is comprised of at least four segments, joined serially one to the other by angularly adjustable hubs, whereby the resulting support frame assembly may be adjusted to fit the surface contours of a variety of vehicles.

There is thus shown in FIG. 9 a vehicle 100 equipped with a message display panel 104 that is borne on a deployable panel support frame 106. Said frame 106 is pivotably attached to an anchor assembly 108, in all respects like anchor assembly 12 illustrated in FIGS. 5(A and B), and in like fashion attachable at the front or rear of vehicle 100 to the bumper or to the frame of vehicle 100.

Panel support frame 106 is comprised of two arms 110, disposed in parallel, each said arm comprising at least four matching elongated segments, respectively including in serial order a lower segment 112, a lower-middle segment 114, an upper-middle segment 116, and an upper segment 118. Each of said four segments in each of arms 110 is joined to the adjoining segments by a multi-position adjustable hub, thereby enabling any desired angle to be set between any two adjoining segments, albeit within a single plane for all segments. Hubs 120 and 120' thus join an end of lower segment 112 of each arm to an end of lower-middle segment 114, hubs 122 and 122' join the other end of lower-middle segments 114 to an end of upper-middle segments 116, and hubs 124 and 124' join the other end of upper-middle segments 116 to an end of upper segments 118.

A first cross-member 126 joins hubs 124 and 124', and a second cross-member 128, parallel to said first cross-member, joins the distal ends of upper segments 118 and 118'. Message display panel 104 is disposed and secured within the rectangle formed by said two cross-members and by upper segments 118 and 118'. At least one work light 102 is secured to frame 106 at or near hub 124.

Each of said frame members is preferably made principally of a lightweight metal or composite material. Preferably at least one matching segment of each of arms 110 and 110' comprises telescoping means for selectively adjusting the length of said segments in order to obtain the most convenient fit to the contours of a particular vehicle when the display panel is in the stored position atop the roof of the vehicle.

Each of adjustable hubs 120, 122 and 124 is adapted to be lockable in any angular position over at least a 90 degree angle, thereby enabling the several elongate segments of each arm 110, when message panel frame 106 is in the down or stored position, to be aligned with the surface contour of the body of the vehicle bearing the message display panel, as shown in FIG. 10. Examples of adjustable and lockable hubs suitable for this purpose are described and illustrated for example in U.S. Pat. No. 4,830,250 issued May 16, 1989 to N. Dixon and N. Levine.

Nature of Message Display Panel

The message display panel to be employed in the several described embodiments of the invention is intended to provide a selection of simple light patterns for informing oncoming motorists of a roadway emergency or work site. Preferably, said display panel comprises a capability to flash alternatively, each for a few seconds, a selected word (including an alphanumeric abbreviation) that identifies the nature of the emergency incident, and also a matrix of arrows and Xs [such as |↑|↑|↑|X] in a choice of configurations designed to represent the open and closed travel lane configuration then in effect.

For example, and as illustrated in FIGS. 11(A–B), the removal of a disabled vehicle from the roadway could be reported to oncoming motorists by displaying and flashing the word "TOW" on the message panel, alternating with a graphical illustration of the open and closed travel lanes.

The display panel preferably consists of a honey-comb or grid of light-emitting elements, which may be conventional outdoor light bulbs, high intensity bulbs, light-emitting diodes. In more expensive systems, LCD (liquid crystal display) display panels may be employed, including color display panel systems. Whatever the precise nature of the light-emitting elements, they may be selectively turned on/off in pre-determined sets, to form words or short phrases, such as "TOW" (to report a vehicle recovery), and also to display simple graphical patterns representing open and closed travel lanes.

In a simple embodiment of the system, which provides only a small number of possible displays, the control of the several signal options could be embodied in a single multi-position rotatable control knob, located in the dashboard area of the cab of the vehicle for the use of the operator in selecting and activating a display. Simple electrical or electronic means, well known in the art, may be employed to program such a control to flash alternately, in intervals of a few seconds, a single word message, such as "TOW" or "CAUTION", and a selected lane conditions display, so both displays will be viewed repeatedly by oncoming traffic as it approaches the display site.

In general the design of light panels having such capabilities, and of the circuitry required to power and control such panels, is well known to persons of skill in the pertinent art and does not require detailed description. For these purposes the prior art developed for example in the design of illuminated panels for use in static highway signage is directly applicable and usable. In general the control of the illumination of the display panels is not part of the present invention and will not be described.

If it is desired to employ a color display system, preferably it should employ three colors of lights, green, yellow (or orange), and red. Using as an example the FIG. 9 message reporting a towing operation from the right shoulder of a three lane highway, the "X" in S[houlder] lane would be in red lights, the arrows representing lanes 2 and 3 would be green lights, and the arrow representing lane 1 would be yellow (or orange); of course, the U.S. Department of Transportation may mandate the use of particular colors in the display of particular highway symbols. The vertical lines representing travel lane markings should preferably be white for the safest travel lane (here lane 4), and orange (yellow) for transitional travel lanes. The vertical line of lights between 4 and 3 is orange (yellow) while all the other vertical lines are white.

It should be clear from the foregoing that the present invention provides enhanced safety and promotes easier traffic flow at a highway emergency site, by providing emergency vehicles with a means to illuminate an emergency site work area, as a normal street light would do, while also providing oncoming motorists with a clear indication of the nature of the emergency operation, and usable information regarding the open and closed travel lanes at the emergency site.

At present, a typical nighttime emergency site on a freeway, say a police vehicle attending to a truck breakdown, appears to oncoming motorists as an indeterminate cluster of flashing lights. Where oncoming traffic approaches such an emergency site around a bend in the road, and the travel-through conditions cannot readily be determined by drivers, a traffic back up is inevitable, with attendant delays. A police cruiser equipped with the present invention would set its display panel to flash "CAUTION", alternating with a pattern of arrows and Xs that identifies the closed and open travel lanes, and either reduce or eliminate the traffic obstruction caused by the breakdown.

Lastly it should be understood that the present invention of a deployable message display panel has been described in the preferred application of roadway emergency vehicles, in view of a clear and present need for the invention in such application. However, the invention may readily be applied in any context (including even so-called "tailgate" parties associated with sporting events) in which it is advantageous to provide vehicle-borne signage and site illumination.

What is claimed is:

1. A deployable message display structure attachable to a vehicle and comprising:

a) anchor means attachable to an end of a vehicle:

b) a message panel supporting frame having two parallel arms hingedly attachable at their lower end to said anchor means whereby said frame is rotatable between a storage position and a substantially vertical message display position;

(c) a message display panel disposed between said arms at the end of said arms distal from said frame's attachment to said anchor means, and (d) at least one work light attached to said frame at a point below said display panel when said frame is in the raised message display position.

2. The deployable message display structure of claim 1 in which said frame further comprises at least one cross-member joining said arms at right angles to said arms.

3. The deployable message display structure of claim 2 where said cross-member is tubular and houses at least one rod, having an end outwardly extractable from an end of said cross-member, for securing said at least one work light.

4. The deployable message display structure of claim 1 wherein said arms are shaped to follow the contours of the upper surface of said vehicle when said structure is in the stored position, whereby said message display panel may then rest substantially flat on the roof of said vehicle.

5. The deployable message display structure of claim 4 wherein each of said arms further comprises hub means whereby said message display panel may selectively be positioned in a vertical viewing position when said structure is in the stored position.

6. The deployable message display structure of claim 1 further comprising powered means for rotating said frame between a storage position and a substantially vertical message display position.

7. The deployable message display structure of claim 6 wherein said powered means comprise a rotatably powered axle positioned longitudinally within a beam forming a part of said anchor means and operatively connected to each of said arms.

8. The deployable message display structure of claim 1 wherein said message display panel comprises means to display at least one alphanumeric message.

9. The deployable message display structure of claim 1 wherein said message display panel comprises means to display a graphical representation of open and closed travel lanes.

10. The deployable message display structure of claim 7 wherein said message display panel further comprises means to display alternatively, in brief flashes, a single word message and a graphical representation of open and closed travel lanes.

11. The deployable message display structure of claim 1 wherein the attachment of at least one work light to said frame comprises a rod having one end pivotally attached to an arm of said frame and having a work light attached to its opposite end.

12. The deployable message display structure of claim 1 comprising at least one work light secured to said frame by electro-mechanical means for selectively directing the light from said work light in a plurality of directions.

13. A deployable and adjustable message display structure attachable to a vehicle and comprising:

(a) anchor means attachable to the front or rear of a vehicle;

(b) a message panel supporting frame having two parallel arms each having at least four elongate sections including a lower section, a lower-middle section, an upper-middle section and an upper section, whereby one end of said lower section is hingedly attachable to said anchor means, a first angularly adjustable hub joins the other end of said lower section to an end of said lower-middle section, a second angularly adjustable hub joins the other end of said lower-middle section to an end of said upper-middle section, and a third angularly adjustable hub joins the other end of said upper-middle section to said upper section;

(c) a message display panel disposed between the upper elongate section of said arms, whereby said message panel supporting frame is rotatable between a storage position in which said elongate sections of said frame are substantially aligned with the upper surface of said vehicle and a substantially vertical message display position.

14. The deployable message display structure of claim 13 further comprising at least one work light attached to said frame at a point on said frame below said display panel when said display panel is in a viewable position.

15. The deployable message display structure of claim 13 in which said frame further comprises at least one cross-member joining the upper section of said arms at right angles to said arms.

16. The deployable message display structure of claim 13 having a tubular cross-member housing at least one rod, said rod having an end outwardly extractable from an end of said cross-member, for securing a work light at said rod end.

17. The deployable message display structure of claim 13 wherein each of said first, second and third hubs may be angularly set and locked at angles respectively selected so that the arm assembly generally follows the upper surface contour of said vehicle when said structure is in the stored position, whereby said message display panel then rests substantially flat on the roof of said vehicle.

18. The deployable message display structure of claim 17 wherein, in each of said arms, at least one complementary elongate section comprises telescoping means for adjusting the length of said section.

19. The deployable message display structure of claim 13 further comprising powered means for rotating said frame between a storage position and a substantially vertical message display position.

20. The deployable message display structure of claim 19 wherein said powered means comprise a rotatably powered axle positioned longitudinally within a beam forming a part of said anchor means and operatively connected to each of said arms.

21. The deployable message display structure of claim 13 wherein said message display panel comprises means to display at least one alphanumeric message.

22. The deployable message display structure of claim 13 wherein said message display panel comprises means to display a graphical representation of open and closed travel lanes.

23. The deployable message display structure of claim 22 wherein said message display panel further comprises means to display alternatively, in brief flashes, a single word message and a graphical representation of open and travel closed lanes.

24. The deployable message display structure of claim 14 wherein at least one said work light is secured to said frame by electro-mechanical means for selectively directing the light from said work light in a plurality of directions.

* * * * *